US007793769B2

(12) United States Patent
Kumabe et al.

(10) Patent No.: US 7,793,769 B2
(45) Date of Patent: Sep. 14, 2010

(54) AUTOMATIC VENDING MACHINE

(75) Inventors: Takashi Kumabe, Tokyo (JP); Minoru Honjo, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 810 days.

(21) Appl. No.: 10/596,906

(22) PCT Filed: Dec. 27, 2004

(86) PCT No.: PCT/JP2004/019560

§ 371 (c)(1),
(2), (4) Date: Jun. 28, 2006

(87) PCT Pub. No.: WO2005/064556

PCT Pub. Date: Jul. 14, 2005

(65) Prior Publication Data

US 2007/0175915 A1 Aug. 2, 2007

(30) Foreign Application Priority Data

Dec. 26, 2003 (JP) ..... 2003-435962

(51) Int. Cl.

| | |
|---|---|
| ***G07F 5/00*** | (2006.01) |
| ***G07F 11/00*** | (2006.01) |
| ***G07F 13/00*** | (2006.01) |
| ***G07F 15/00*** | (2006.01) |
| ***B65H 31/20*** | (2006.01) |

(52) U.S. Cl. ..... 194/240; 194/2; 221/114; 221/118; 221/67; 221/242; 221/116; 221/115; 221/117; 221/123; 221/124; 221/129; 221/227; 221/154; 221/6; 221/11; 221/17

(58) Field of Classification Search ..... 310/75 B; 221/133, 11, 114, 118, 67, 242, 115, 116, 221/117, 123, 124, 129, 227, 154, 6, 17; 194/2, 240

See application file for complete search history.

(56) References Cited

U.S. PATENT DOCUMENTS

| | | | | |
|---|---|---|---|---|
| 1,852,733 A | | 4/1932 | Brown | |
| 2,671,546 A | * | 3/1954 | Weiler | 194/225 |
| 3,163,327 A | * | 12/1964 | Maxwell | 221/114 |
| 4,109,825 A | * | 8/1978 | Weitzman | 221/14 |
| 4,121,603 A | * | 10/1978 | Hayashi | 453/21 |

(Continued)

FOREIGN PATENT DOCUMENTS

| | | |
|---|---|---|
| DE | 19909866 | 9/2000 |

(Continued)

*Primary Examiner*—Gene O. Crawford
*Assistant Examiner*—Rakesh Kumar
(74) *Attorney, Agent, or Firm*—Rankin, Hill & Clark LLP

(57) ABSTRACT

The present invention provides a vending machine that converts a force applied from a manual operation means into an electric power, and operates by utilizing the electric power as a source of power. A drive force generation/transmission mechanism includes a generator (45) that generates the electric power by utilizing the force applied from the manual operation means (9) and motors (49-55) driven by the electric power generated by the generator (45). Article moving mechanisms (63-69) are constructed to operate by utilizing the output of the motors (49-55) as the operation source.

13 Claims, 19 Drawing Sheets

U.S. PATENT DOCUMENTS

| | | | | |
|---|---|---|---|---|
| 4,480,764 | A * | 11/1984 | Takagi et al. | 221/11 |
| 5,020,725 | A * | 6/1991 | Waldrum | 239/154 |
| 5,172,828 | A * | 12/1992 | Ficken et al. | 221/11 |
| 5,472,074 | A * | 12/1995 | Milcetic | 194/342 |
| 5,605,249 | A * | 2/1997 | Gonyea | 221/6 |
| 6,247,611 | B1 * | 6/2001 | Clements et al. | 221/277 |
| 2003/0011330 | A1 | 1/2003 | Machalek | |
| 2003/0057227 | A1 | 3/2003 | Janssen | |
| 2003/0183645 | A1 * | 10/2003 | Shin | 221/133 |

FOREIGN PATENT DOCUMENTS

| | | |
|---|---|---|
| FR | 1460027 | 6/1966 |
| GB | 2134091 | 8/1984 |
| JP | 57-9838 | 2/1982 |
| JP | 05-290268 | 11/1993 |
| JP | 6-59977 | 8/1994 |
| JP | 06-325248 | 11/1994 |
| JP | 3014387 | 5/1995 |
| JP | 08-057149 | 3/1996 |
| JP | 08-212438 | 8/1996 |
| JP | 08-293061 | 11/1996 |
| JP | 09-099171 | 4/1997 |
| JP | 11-156039 | 6/1999 |
| JP | 11-345360 | 12/1999 |
| JP | 2000-123229 | 4/2000 |
| JP | 2002-092713 | 3/2002 |
| JP | 2002-133492 | 5/2002 |
| NL | 8801951 | 3/1990 |

* cited by examiner

AUTOMATIC VENDING MACHINE

TECHNICAL FIELD

The present invention relates to a vending machine capable of automatically vending an article using a mechanism, which operates using a force applied from a manual operation means without using electrical driving device.

BACKGROUND ART

The Japanese Utility Model Publication No. S57-9898, Japanese Utility Model Registration No. 3014387, Japanese Patent Laid-Open Publication No. H08-212438, and Japanese Patent Laid-Open Publication No. 2002-133492, disclose structures of vending machines for vending an article such as a toy contained in a plastic capsule without large angular portions on its surface in exchange of a predetermined number of coins. In these vending machines, an article selection mechanism or article moving mechanism, which is equipped with a rotating drum and a rotating disk, is disposed under an article stocker chamber containing the articles. The article selection mechanism randomly selects one of the articles stored in the article stocker chamber and moves the same to an article dispensing opening.

Patent document 1: Japanese Utility Model Publication No. S57-9898

Patent document 2: Japanese Utility Model Registration No. 3014387

Patent document 3: Japanese Patent Laid-Open Publication No. H08-212438

Patent document 4: Japanese Patent Laid-Open Publication No. 2002-133492

DISCLOSURE OF THE INVENTION

Problem to be Solved by the Invention

When vending articles contained in a case having an aspheric outer shape like a box-shaped case or a case having a spherical outer shape using a structure of a conventional vending machine, since the case does not rotate freely, articles get stuck in an article selection mechanism or article moving mechanism, there arises such a problem that articles are hardly guided to an article dispensing opening smoothly. Also, when articles are contained in a recyclable paper case in place of a plastic capsule which cannot be recycled, there arises such a problem that the paper case may be deformed in an article stock chamber of a conventional apparatus.

An object of the present invention is to provide a vending machine that converts a force, which is applied from a manual operation means, into electric power and operates by using the electric power as a source of power.

Another object of the present invention is to provide a vending machine capable of reliably collecting coins.

A further object of the present invention is to provide a vending machine capable of reliably carrying out dispensing operation of articles and collecting operation of coins with a simple arrangement.

Still another object of the present invention is to provide a vending machine capable of various displays requiring electricity such as voice indication or the like without using commercial power.

Means for Solving the Problem

A vending machine of which improvements the present invention aims at comprises an article stocker that stores a plurality of articles, an article moving mechanism that moves at least one of the plurality of articles stored in the article stocker into an article guide path, a manual operation means that is manually driven, and a drive force generation/transmission mechanism that generates a drive force by utilizing a force applied from the manual operation means and transmits the drive force to the article moving mechanism as an operation source.

The shape of a case for the articles are arbitrary, for example, spherical, columnar, or box-like. The manual operation means may be anything that applies a drive force with a manual operation, for example, a lever type, dial type or rotary type. The coins required for purchasing articles may be genuine coins or substitute coins such as medals or other disk-shaped members that can be used as a symbol of economic value in a location where the vending machine is installed.

In the present invention, the drive force generation/transmission mechanism includes a generator that generates electric power by utilizing a force applied from the manual operation means and a motor driven by the electric power generated by the generator. The article moving mechanism is constructed to operate by utilizing the output of the motor as an operation source. Not only a single generator but also a plurality of generators may be used. Also, it is needless to say that a plurality of motors may be used in accordance with the number of the article stockers and the arrangement of the article moving mechanism.

According to the present invention, since the motor is driven by utilizing the electric power obtained by rotating the generator by means of the force applied from the manual operation means, the arrangement of the drive force generation/transmission mechanism is simpler than that ever. Therefore, the vending machine can be designed more easily. In addition, even when the number of the article stockers increases, the arrangement of the drive force generation/transmission mechanism is not complicated. Also, since the vending machine is provided with the generator, electrical and voice indication is achieved without using commercial power.

When there is an extra output of the generator, a part of the output may be stored in a rechargeable secondary battery or capacitor. When there is no extra output of the generator, a part of the electric power necessary for displaying may be supplemented by using a primary battery.

Further, when the capacity and the number of the generators are increased, since the load of the manual operation means become larger, a large force is required for driving the manual operation means. Therefore, in such a case, the manual operation means includes a rotary member that rotates about a rotating shaft and a handle section provided at the rotary member, which is driven to rotate the rotary member. The drive force generation/transmission mechanism may include an accelerating mechanism that causes the rotating shaft of the generator to rotate at a higher speed than that of the rotary member by utilizing the rotation of the rotary member. By adopting such arrangement, the production of electricity of the generator can be easily increased.

Even when a plurality of article stockers (n article stockers: n is an integer of 2 or more) are provided, a single article guide path is preferably provided for them. In this case, the drive force generation/transmission mechanism includes a generator that generates an electric power by utilizing a force applied from the manual operation means, n motors that are selectively driven by utilizing the electrical power generated by the one generator, and an motor selection/drive device that drives only one of the motors, which is selected when the manual operation means is operated (selection indicated by inserting coins or the like). The drive force generation/transmission mechanism selectively transmits the output of the n motors, as the operation source, respectively to the n article moving mechanisms correspondingly provided for the n article stockers. Further, each of the n article moving mechanisms moves in to the article guide path one article selected from the plurality of articles stored in the corresponding article stocker, being driven by the drive force transmitted from the corresponding motor included in the drive force generation/transmission mechanism.

As described above, even when the kind of articles or the storing capacity for the articles is increased by using the plurality of article stockers, only a required motor is driven by using motor selection/drive device. Therefore, even when the output of the generator is small, the article can be taken out of the plurality of article stockers.

The drive force generation/transmission mechanism preferably include n coin collecting devices corresponding to the n article stockers for collecting a required number of coins for dispensing the article. The motor selection/drive device is constructed to select the motor corresponding to the coin collecting device into which the required number of coins are inserted and only the selected motor is supplied with the electric power from the generator. By associating the completion of coin insertion with the drive of the motor as described above, only the required motor is reliably driven to dispense the article. Thus, the energy can be saved.

The coin collecting device is constructed to collect the inserted coins after the article has been moved into the article guide path by the operation of the article moving mechanism. With the arrangement as described above, it is possible to prevent such a problem that the inserted coins are collected without dispensing the article.

Also, the motor selection/drive device is preferably arranged as described below. When the required number of coins are inserted in a plurality of coin collecting devices, the timing of starting to drive each of the plurality of motors corresponding to the plurality of coin collecting devices may preferably be set differently to prevent two or more articles from being moved into the article guide path at almost the same timing due to the operation of the plurality of article moving mechanisms. With the arrangement as described above, since the plurality of motors are prevented from being activated at the same time, such a situation can be avoided that the plurality of articles are dispensed simultaneously from the plurality of article stockers into the article guide path and the articles get stuck inside the article guide path.

The coin collecting device is preferably constructed to permit the inserted coins to be reset only when the article moving mechanism is at the operation start position. With the arrangement as described above, since the coins are prevented from being reset while the article is being dispensed, even when the reset operation is made while operating the manual operation means, the reset operation does not function. Therefore, such an unfavorable situation can be avoided that the article is dispensed, and at the same time coins are returned by the reset operation.

The article moving mechanism may include a rotating shaft having an axis line that coincides with a center line of the article stocker and driven to rotate by the drive force to rotate the article stocker, a first moving mechanism that moves the article to a predetermined position from the article stocker, which is rotated as the rotating shaft rotates, and a second moving mechanism that moves the article, which has been moved to the predetermined position in the article guide path as the rotating shaft rotates. By constructing the article moving mechanism of the first and second moving mechanism as described above, the article can be moved into the article guide path smoothly and easily in accordance with the movement of the one rotating shaft.

BEST MODE FOR IMPLEMENTING THE INVENTION

Figure 1:
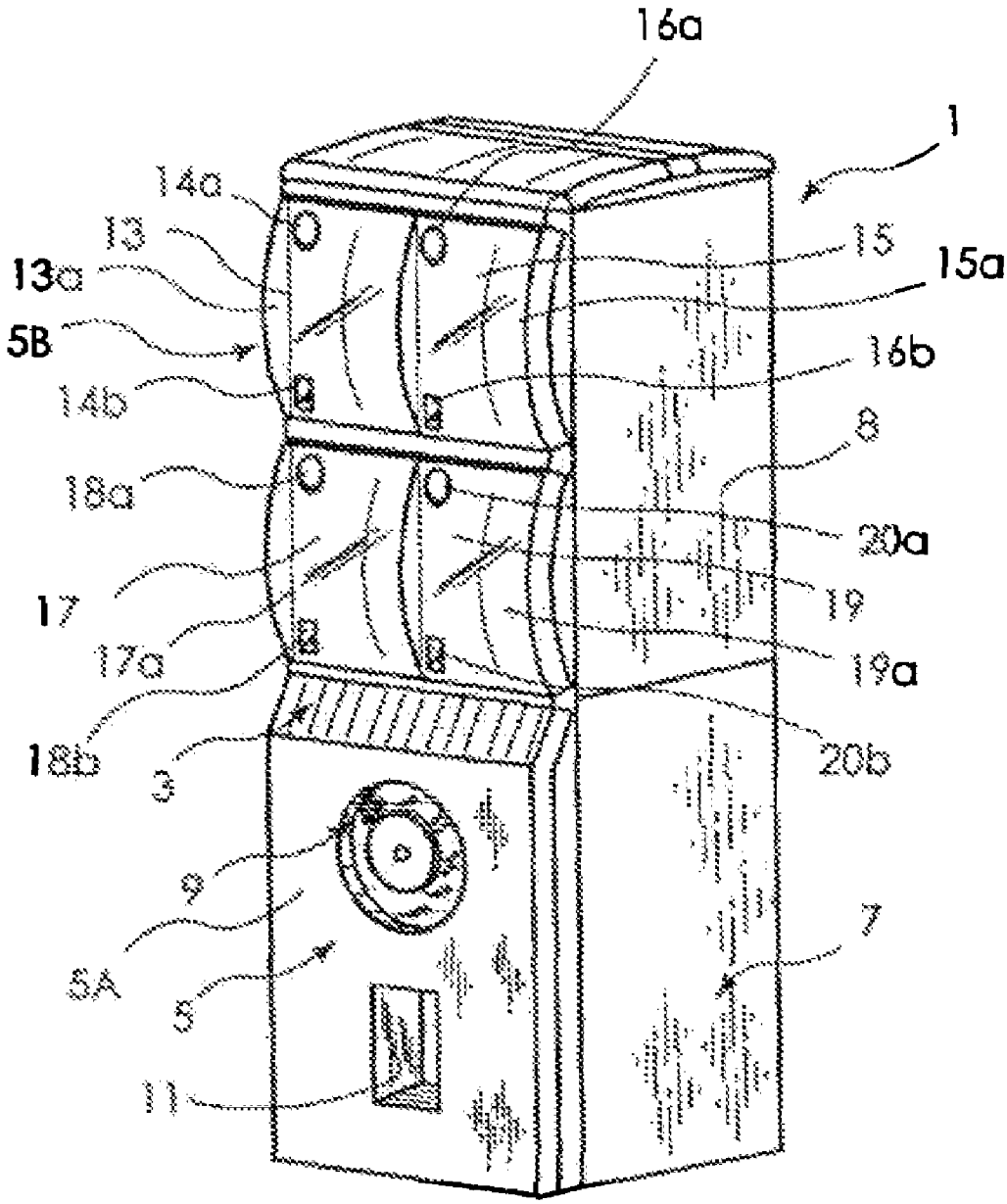
FIG. 1 is a perspective view of a vending machine according to one embodiment of this invention.
Figure 2:
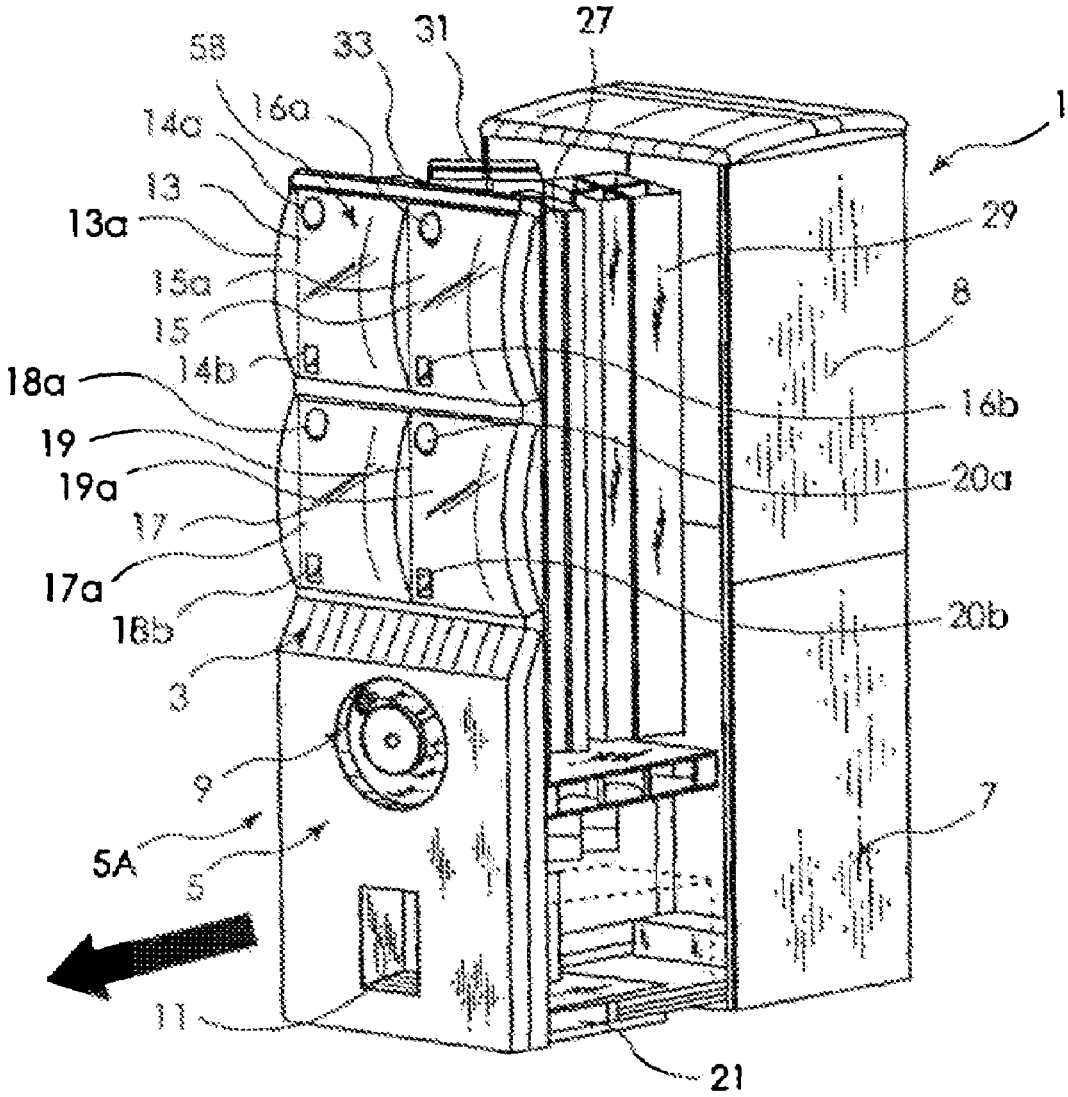
FIG. 2 is a perspective view showing a front panel drawn out forward from a case body.

One embodiment of a vending machine according to the present invention will be described in detail by referring to the accompanying drawings. FIG. 1 is a perspective view of one embodiment of the vending machine according to this invention. The vending machine 1 comprises a storage case 3 including a front panel 5 and a case body 7. The front panel 5 is constructed to be removable from the case body 7. FIG. 2 shows the front panel 5 drawn out forward from the case body 7. In FIG. 2, only a part 21 of a frame mounted onto the back of the front panel 5 is shown. A front portion of the front panel 5 comprises a lower half portion 5A and an upper half portion 5B. The lower half portion 5A has a manual operation means 9, provided commonly for four article stockers, and an article dispensing opening 11. The upper half portion 5B is provided with four coin collecting device containers 13-19 where four coin collecting devices corresponding to the four article stockers 27-33, which will be described in detail later, are installed. The coin collecting device containers 13-19 have transparent covers 13*a*-19*a*, through which an inner display portion can be seen. The covers 13*a*-19*a* are provided respectively with four coin slots 14*a*, 16*a*, 18*a*, 20*a* associated respectively with the four coin collecting device containers 13-19. The covers 13*a*-19*a* are also provided with returned coin pickup openings 14*b*, 16*b*, 18*b*, 20*b*, to which coins are returned by a cancel or reset operation.

Figure 3:
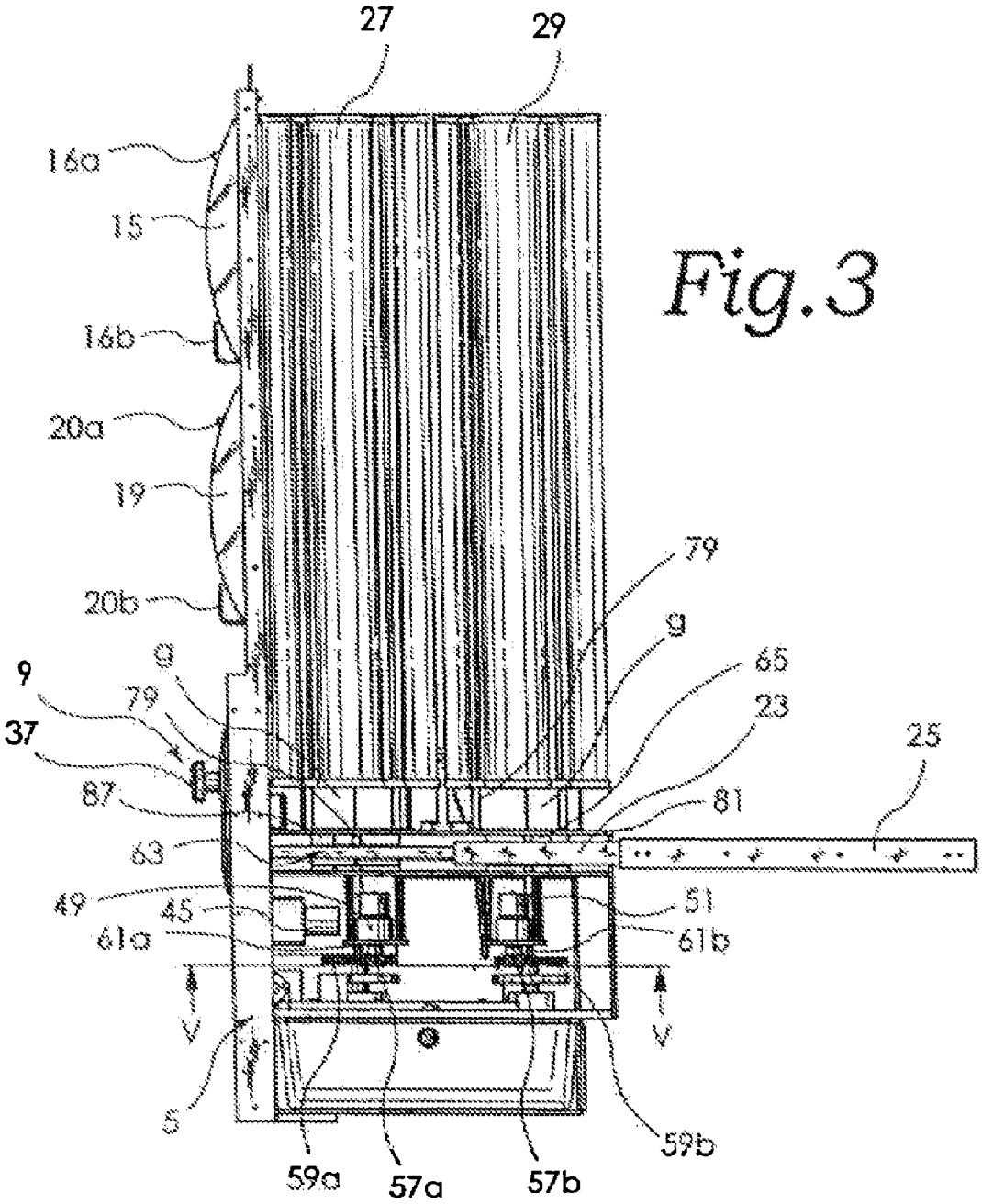
FIG. 3 is a detailed view showing the front panel drawn out forward from the case body.

As detailed in FIG. 3, a part 23 of the frame is mounted onto the back of the front panel 5. The article stockers 27-33, which will be described later, a guide path, a drive force generation/transmission mechanisms and article moving mechanisms are installed in the frame. The frame as a whole is constructed to have an enough mechanical strength to support the article stockers, guide path, drive force generation/transmission mechanisms and article moving mechanisms. FIG. 3 shows a slide frame 23 used to draw out the front panel 5 forward to the front. FIG. 3 also shows another frame 25 behind the frame 23, which is a rail frame constituting a frame holding structure mounted onto the case body 7. In FIG. 3, the lower frame 21 that is shown in FIG. 2 is omitted. If the frame 23 and the frame 25 have sufficient mechanical strength, the lower frame 21 shown in FIG. 2 is not necessary. This arrangement facilitates maintenance and inspection works because virtually the whole inner drive construction comes out when the front panel 5 is drawn out forward. In addition, additional articles can be replenished easily to the article stockers 27-33.

In the upper half portion of the storage case 3, side walls 8 of the storage case 3 are constituted by a transparent or translucent material so that main portions of the article stockers 27-33 described later can be seen from outside the storage case 3. Further, the main portions of the article stockers 27-33 are also constituted by a transparent or translucent material. With this arrangement, the article stockers 27-33 can be seen from the outside, thereby allowing the remaining articles to be checked. Thus, the timing for replenishment of the articles can easily be determined. This arrangement, namely, allowing the articles to be seen from the outside, also motivates the consumers to buy them.

Figure 4:
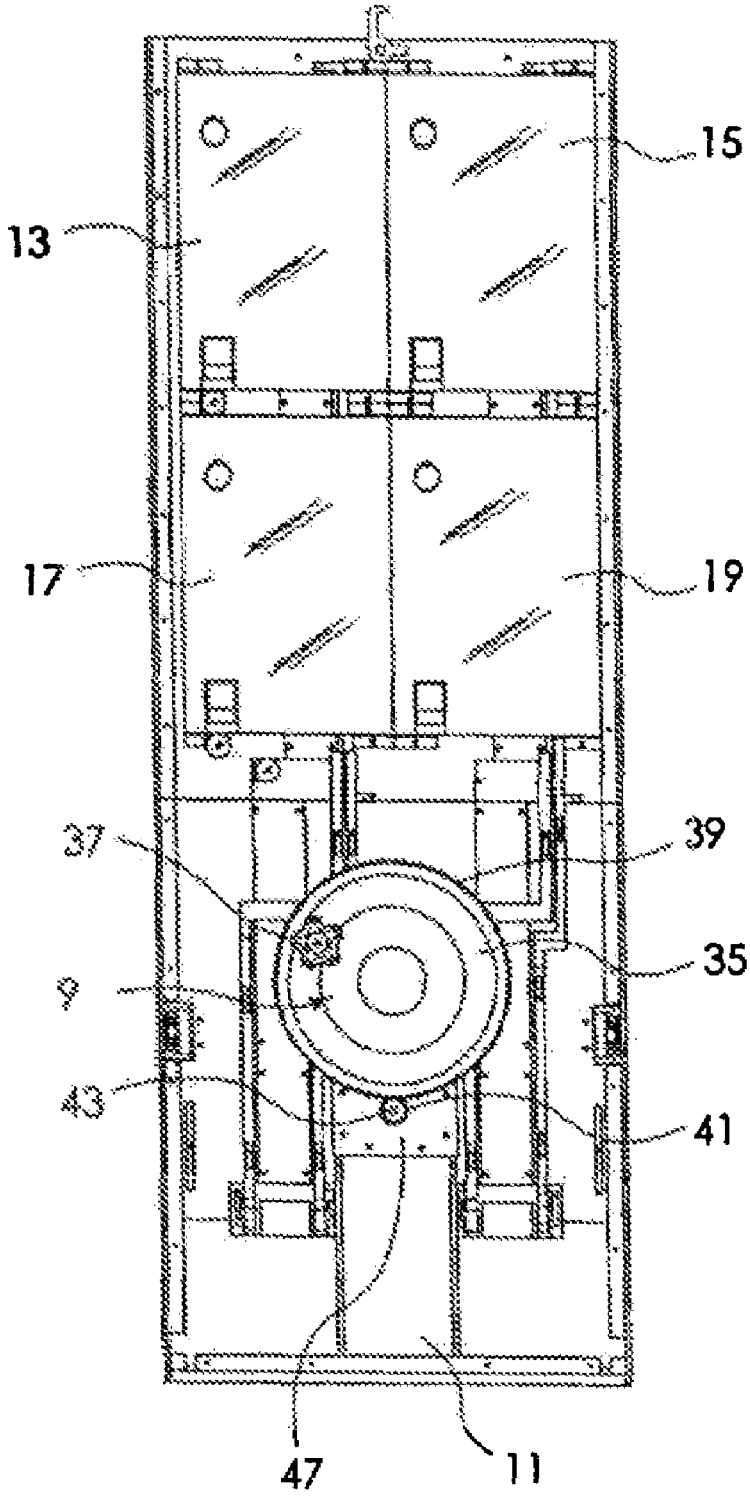
FIG. 4 is a front view of the vending machine with a panel portion of the front panel removed.
Figure 5:
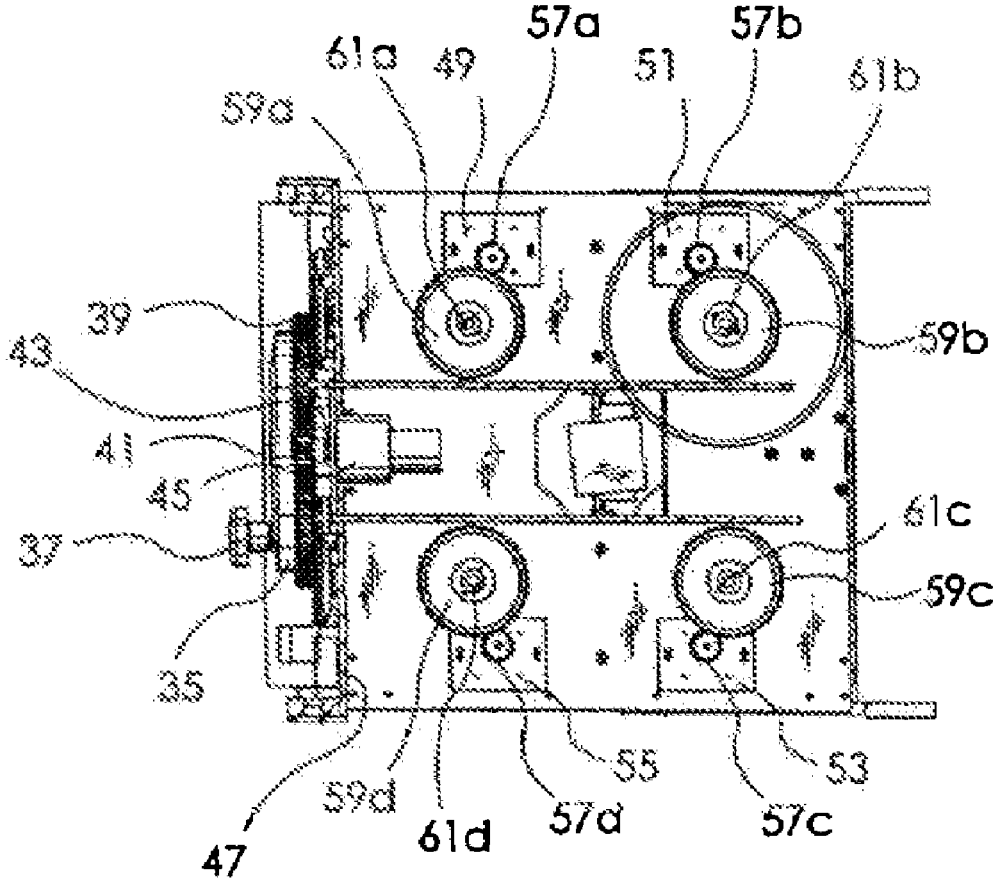
FIG. 5 is a cross-sectional view taken along the line A-A of FIG. 3.
Figure 6:
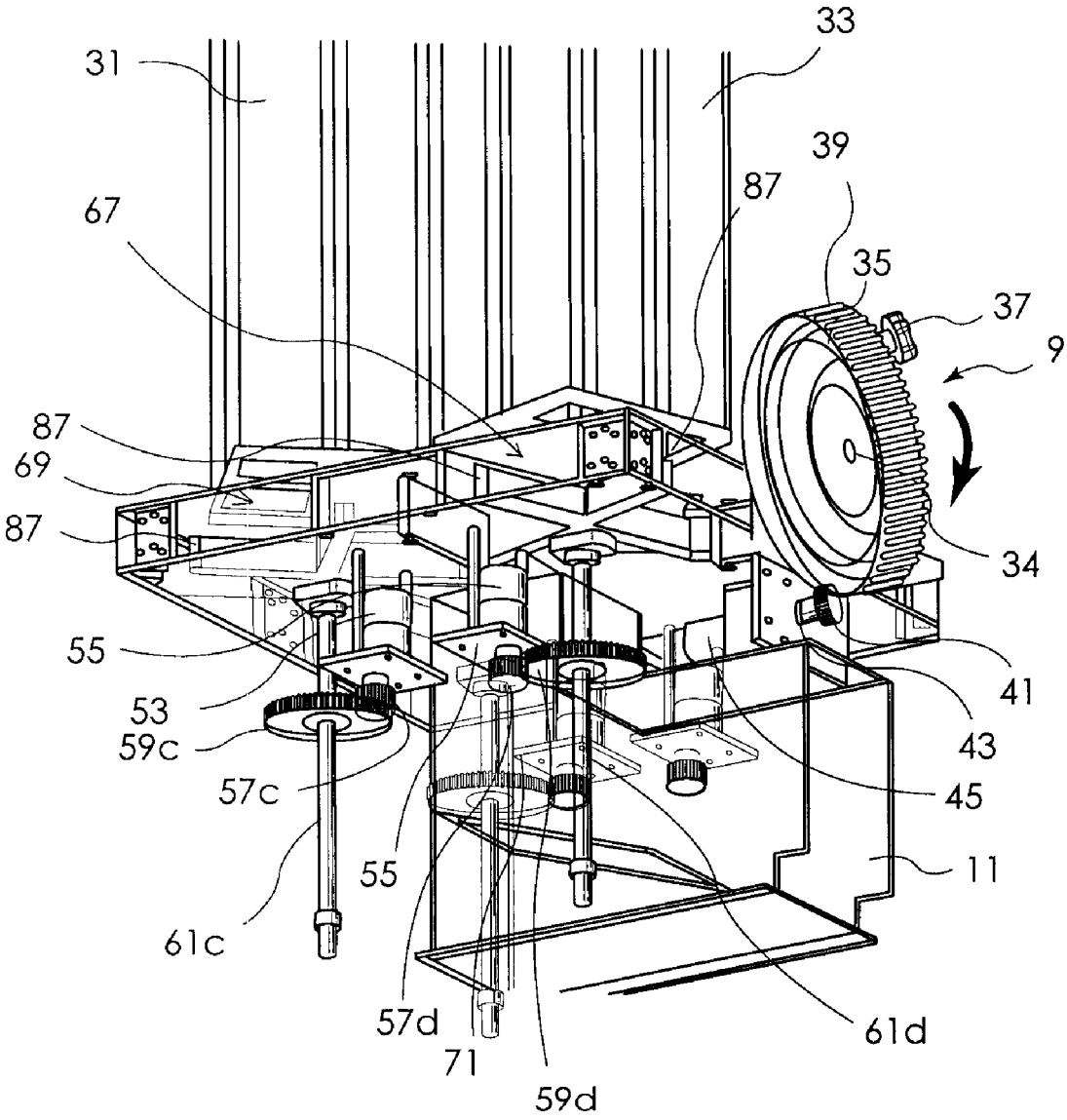
FIG. 6 is a perspective view of an inner mechanism as seen from diagonally below.

The manual operation means 9 may simply be anything can apply a drive force by the manual operation. In this example, a rotary operation means is employed. FIG. 4 shows a front view of the vending machine with the panel portion of the front panel 5 removed from the view. FIG. 5 shows a cross-sectional view taken along the line A-A of FIG. 3. FIG. 6 shows a perspective view of an inner mechanism as seen from diagonally below. As shown in FIG. 5 and FIG. 6, the manual operation means 9 includes a disk-like rotary member 35 that rotates about a rotating shaft 34 (FIG. 6), and a knob-like handle 37 rotatably arranged relative to the rotary member 35. Behind the disk-shaped rotary member 35, a circular gear 39 is arranged. Below the rotary member 35, a small gear 41 is arranged, being in mesh with the gear 39. A shaft 43 of the small gear 41 is directly coupled with a rotating shaft of a rotary generator 45, as shown in FIG. 5.

The generator 45 is mounted onto a front side frame member 47. As shown in FIG. 3, FIG. 5 and FIG. 6, electricity produced by the generator 45 is supplied as power source to four motors 49, 51, 53, 55. As the generator 45 starts power generation, the electricity generated by the generator 45 is selectively supplied to the motors through a control circuit. Output shafts of the motors 49-55 are provided with small-diameter gears 57*a*-57*d* that constitute a part of a decelerating mechanism. These small gears 57*a*-57*d* are in mesh with large-diameter gears 59*a*-59*d* that constitute a part of the decelerating mechanism. The gears 59*a*-59*d* are respectively supported on rotating shafts 61*a*-61*d*. The rotating shafts 61*a*-61*d* respectively constitute drive shafts of the article moving mechanisms 63, 65 (FIG. 3), 67, 69 (FIG. 6) that act to rotate the article stockers 27-33.

In this embodiment, the gear 39 and the small gear 41 jointly constitute an accelerating mechanism that causes the rotating shaft of the generator 45 to rotate at a higher speed than that of the rotary member 35 as the rotary member 35 is turned. The accelerating mechanisms 39, 41, the generator 45, the motors 49-55, the gears 57*a*-57*d* and the gears 59*a*-59*d* jointly constitute a drive force generation/transmission mechanism which utilizes a force applied from the manual operation means 9 to generate a drive force and transmits the drive force to the article moving mechanisms 63, 65, 67, 69.

Next, by referring mainly to FIG. 7 to FIG. 10, the arrangements of the article stockers 27-33 and the article moving mechanisms 63, 65, 67, 69 that move one of a plurality of articles stored in the article stockers 27-33 into one guide path 71 will be described below. As typically shown in FIG. 8, each of the article stockers 27-33 includes four article receiving paths 73*a*-73*d* in each of which a plurality of articles are vertically stacked one upon another. The four article receiving paths 73*a*-73*d* are arranged to surround a vertically extending center line 77. More specifically, the four article receiving paths 73*a*-73*d* surround the vertically extending center line 77, and separation walls 79*a*-79*d* are provided to separate two adjoining article receiving paths among the article receiving paths, and adapted to extend radially from the center line 77 at an angular interval of 90 degrees (=360°/4) When the number of article receiving paths is m, the separation walls may be arranged at an angular interval of 360°/m (m is a positive integer of two or more). The article receiving paths 73*a*-73*d* have their upper and lower ends open. As shown in FIG. 3, between the lower ends of the article receiving paths 73*a*-73*d* and an upper partition wall 81 described later, there is a gap g, in which the lower ends of the separation walls 79*a*-79*d* are exposed. The center line 77 coincides with the axis of the rotating shaft 61*d*.

The relation among the article stockers 27-33, the upper partition wall 81 and an upper through-hole 85 formed in the upper partition wall 81 are described as follows: the weight of the articles received in the article receiving paths 73*a*-73*d* is entirely supported by the upper partition wall 81 until article passes through the upper through-hole 85 and falls onto a lower partition wall 83. In this arrangement, all the weight of the articles in the article receiving paths is supported by the upper partition wall 81. Thus, the rotating shafts 61*a*-61*d* can be prevented from being subjected to an excessive force. Further, since the weight of the articles situated above an article being moved is borne by the upper partition wall 81, the article that has landed on the lower partition wall 83 is prevented from being subjected to excessive force and thus can be placed smoothly into the guide path.

Each of the article moving mechanisms 63, 65, 67, 69 (FIG. 3, FIG. 6) may include a first moving mechanism and a second moving mechanism. The first moving mechanism moves articles sequentially from the four article receiving paths 73*a*-73*d* to a predetermined position as the rotating shafts 61*a*-61*d* are rotated by the associated motors 49-55. The second moving mechanism moves the article, which has been moved to the predetermined position by the rotation of the rotating shafts 61*a*-61*d*, into the guide path 71.

In this example, as the first moving mechanism for the article moving mechanisms 63, 65, 67, 69, a free fall type moving mechanism is used. More specifically, the first moving mechanism comprises the upper partition wall 81 and the lower partition wall 83 that are disposed below the article stockers 27-33, vertically spaced from each other and extend perpendicular to the rotating shafts 61*a*-61*d*. The first moving mechanism also comprises those portions of the separation walls 79*a*-79*d* that are exposed in the gap g. The upper partition wall 81 is formed with the upper through-hole 85 through which one article is allowed to fall from one of the article receiving paths onto the lower partition wall 83 while the article stockers 27-33 are rotating about the rotating shafts 61*a*-61*d*. The shape and position of the upper through-hole 85 are determined so that, when the rotating shafts 61*a*-61*d* are at rest at a rotation start position, the articles are prevented from falling from the article receiving paths into the upper through-hole 85. This arrangement can therefore prevent the articles from falling from the upper through-hole 85 onto the lower partition wall 83 during standby even if the vending machine is applied with external vibrations.

Figure 9:
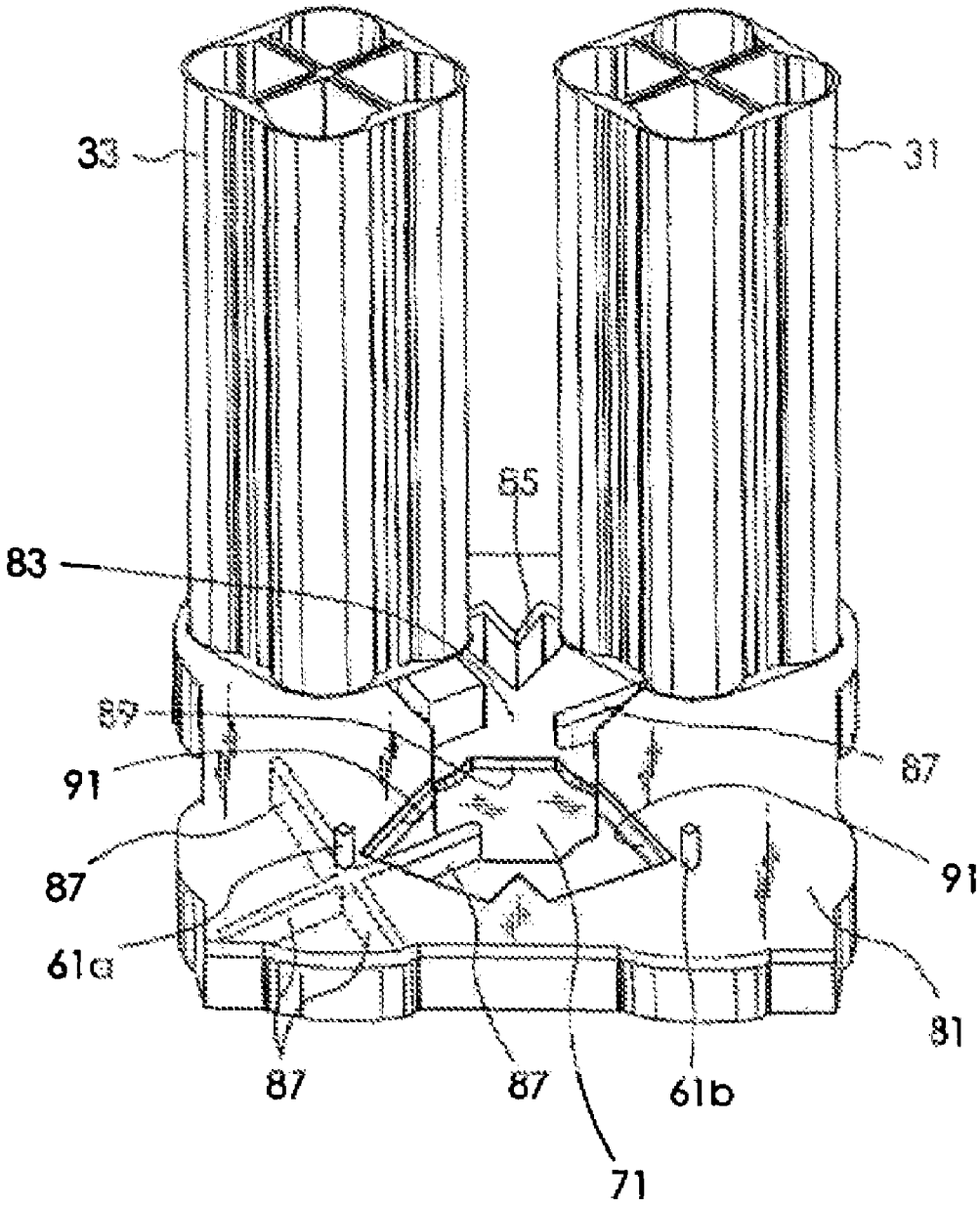
FIG. 9 is a perspective view showing a relation between the article stocker and article moving mechanism.

The second moving mechanism is preferably a rotary moving mechanism. The rotary moving mechanism is disposed between the upper partition wall 81 and the lower partition wall 83 and rotates together with the rotating shafts 61*a*-61*d* to put the article, which has fallen onto the lower partition wall 83, into the guide path 71. More specifically, as best shown in FIG. 6 and FIG. 9, four push plates 87 radially extending 90 degrees apart are secured onto the rotating shafts 61*a*-61*d* to constitute the rotary moving mechanism. The four push plates 87 are arranged to coincide with the separation walls 79*a*-79*d* provided in the article stockers (when seen from above, the four push plates 87 and the separation walls 79*a*-79*d* overlap).

The lower partition wall 83, as shown in FIG. 9, is formed with a lower through-hole 89 that guides an article to the guide path 71. Between the upper partition wall 81 and the lower partition wall 83, it is preferred that guide walls 91 (FIG. 9) to guide the article to the lower through-hole 89 be provided to ensure the article that has fallen onto the lower partition wall 83 should enter into the guide path 71. These guide walls 91 are adapted to allow the push plates 87 to pass therethrough but not to permit the article to pass therethrough. With such guide walls 91, the article that has landed on the lower partition wall 83 can be moved securely to the guide path 71.

In this arrangement, once it falls from the upper through-hole 85 formed in the upper partition wall 81 onto the lower partition wall 83, the article is not affected by the movement of the article stockers. The rotary moving mechanism can also move the article on the lower partition wall 83 into the guide path without being affected by the article stockers located above the upper partition wall 81. Since the article is not affected by the presence of other articles as it is put into the guide path 71, a plurality of articles may get stuck and fail to be dispensed less frequently.

The distance between the upper partition wall 81 and the lower partition wall 83 is determined so that articles situated above the one that has fallen onto the lower partition wall 83 are prevented from entering into the upper through-hole 85 by the presence of the fallen article. In other words, the upper partition wall 81 and the lower partition wall 83 are spaced so that, with one fallen article occupying the space between the upper partition wall 81 and the lower partition wall 83, other stacked articles can slide down from above the fallen one onto the upper partition wall 81. The edge of the upper through-hole 85 is tapered so that the articles situated above the one that has fallen onto the lower partition wall 83 can smoothly slide onto the upper partition wall 81.

The article moving mechanisms 63-69 are provided one for each of four article guiding portions. The upper partition wall 81 and the lower partition wall 83, however, are provided commonly for these article moving mechanisms. In this embodiment, therefore, the arrangement is very simple.

Figure 7:
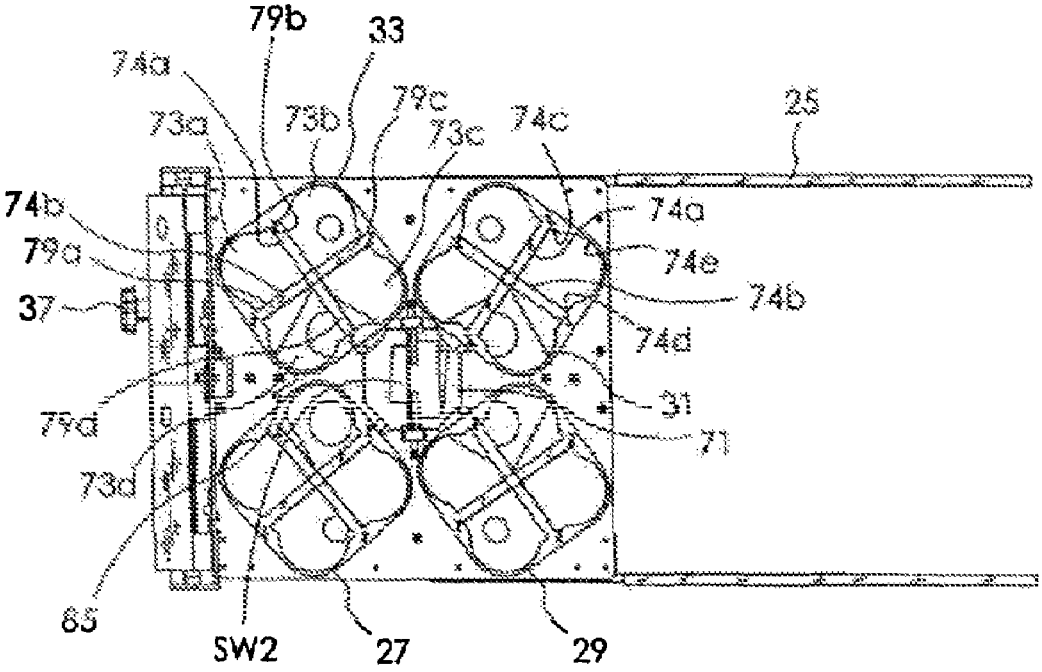
FIG. 7 is a top view of FIG. 2.
Figure 8:
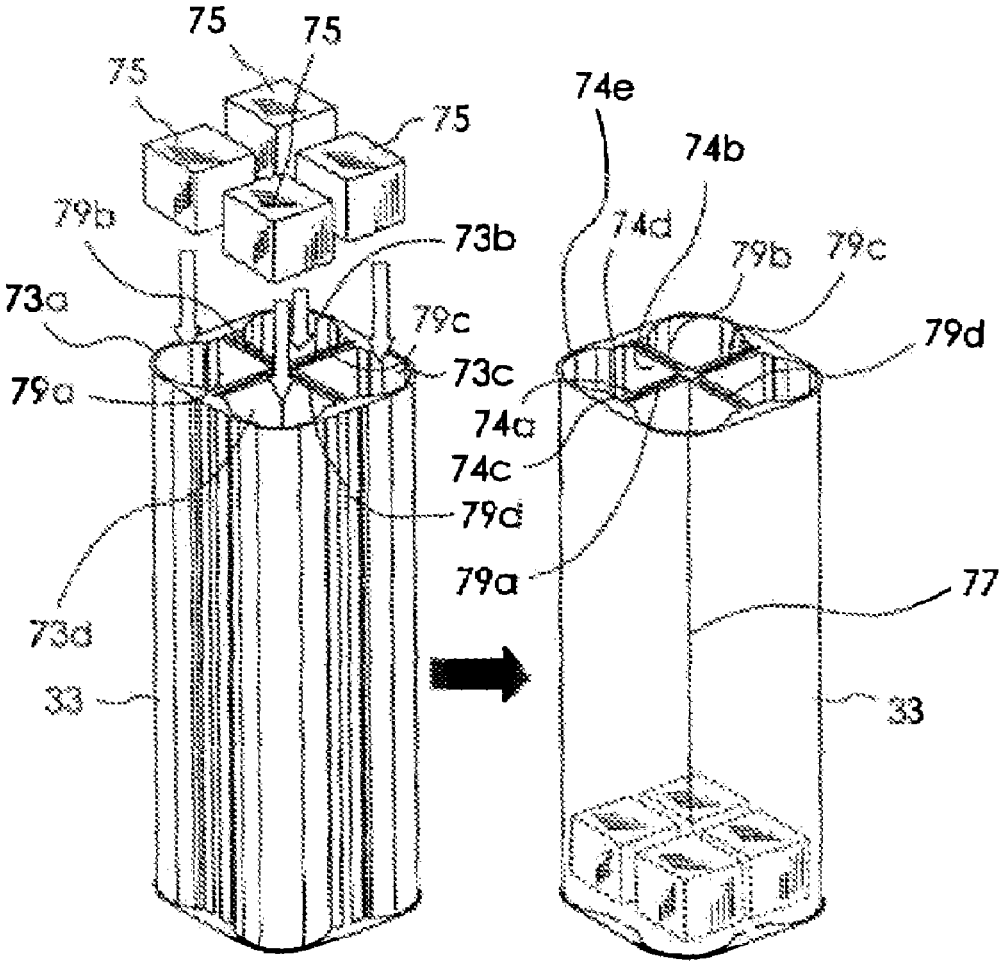
FIG. 8 is a schematic view showing a construction of the article stocker and how articles are stored in the stocker.

As shown in FIG. 7 and FIG. 8, an outline of transverse cross section of each of the article receiving paths 73*a*-73*d* in the article stockers 27-33 of this embodiment has two long sides 74*a*, 74*b* which are longer than one side of the case for the article 75 shown in FIG. 8 and orthogonally crossing each other so that an intersection is formed on a side of the center line, two short sides 74*c*, 74*d* extending from the distal ends of the two long sides 74*a*, 74*b* in directions perpendicular to those of the long sides, and a curved side 74*e* situated outside extensions of the two short sides 74, 74*d* and connecting the two short sides. Determining the transverse cross section of the article receiving paths in this way can prevent the articles from being caught on the inner walls of the article receiving paths even if the article cases tilt inside the paths. This, in turn, effectively prevents the articles from getting stuck in the article receiving paths. With this arrangement, the article receiving paths can receive articles contained in cases of various shapes such as global and oval shapes.

In this embodiment, the article stockers 27-31 are each constructed as a removable unit. As the article stockers 27-31 are moved close to the rotating shafts 61*a*-61*d* of the article moving mechanisms, the article stockers and the article moving mechanisms work in concert with each other. When the article stockers 27-31 are moved away from the rotating shafts 61*a*-61*d* of the moving mechanisms, they no longer work in concert with each other. FIG. 9 shows the article stockers and the rotating shafts, with the article stockers 27 and 29 removed from the view.

Figure 10:
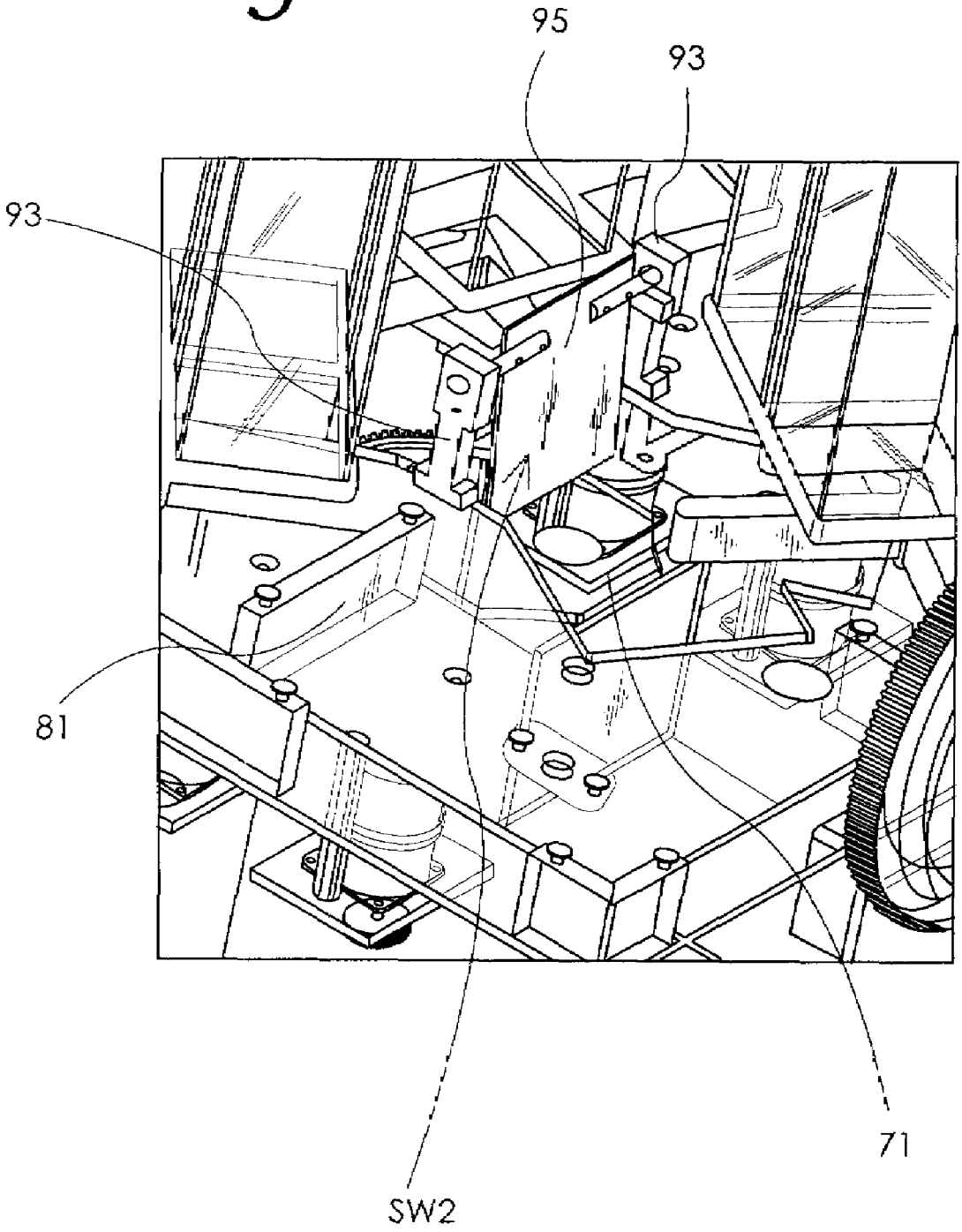
FIG. 10 is a perspective view showing a mounting structure of an article dispensing switch.

As shown in FIG. 7 and FIG. 10, the upper partition wall 81 is provided with an article dispensing check switch SW2 that detects when an article is put into the guide path 71. This switch has a plate 95 mounted onto a support member 93 secured to the upper partition wall 81 in such a manner that the plate can be swung. When the plate 95 is swung by an article as it falls into the guide path 71, a switch not shown turns on or off in response to the motion of the plate 95, detecting that an article is dispensed. Though not shown, each of the article stocker 27-31 is provided with a home position detection switch SW4 (not shown) to detect when each article stocker is at the home position (rotation start or stop position at which the article stockers 27-31 starts rotating in an angular range of 90°). This home position detection switch SW4 may be constructed by a limit switch driven by the separation walls 79*a*-79*d* or the push plates 87.

Figure 11A:
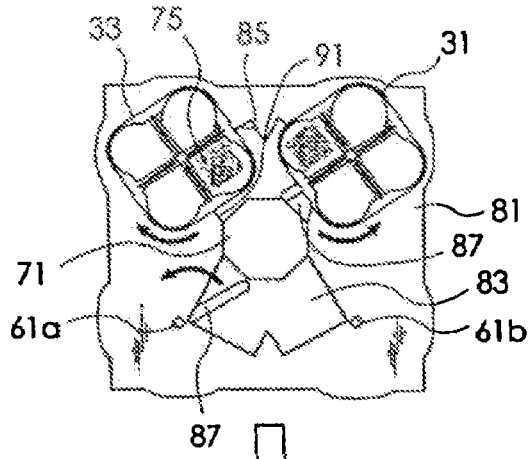
FIGS. 11A to 11C illustrate how the arrangement of this embodiment work.
Figure 11B:
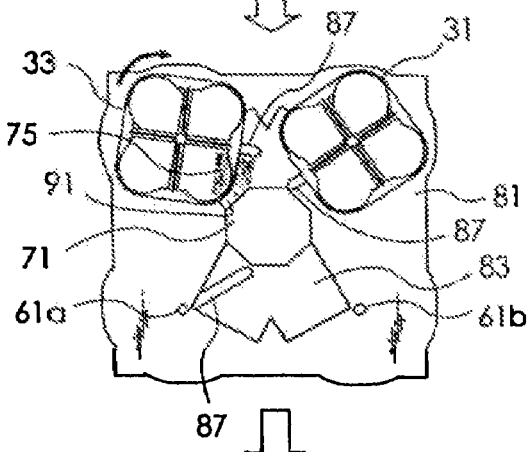
Figure 11C:
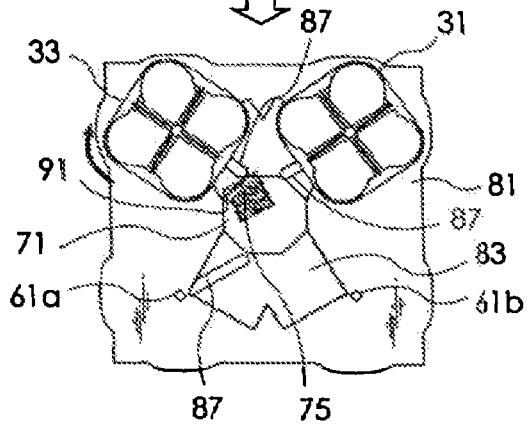
Figure 12:
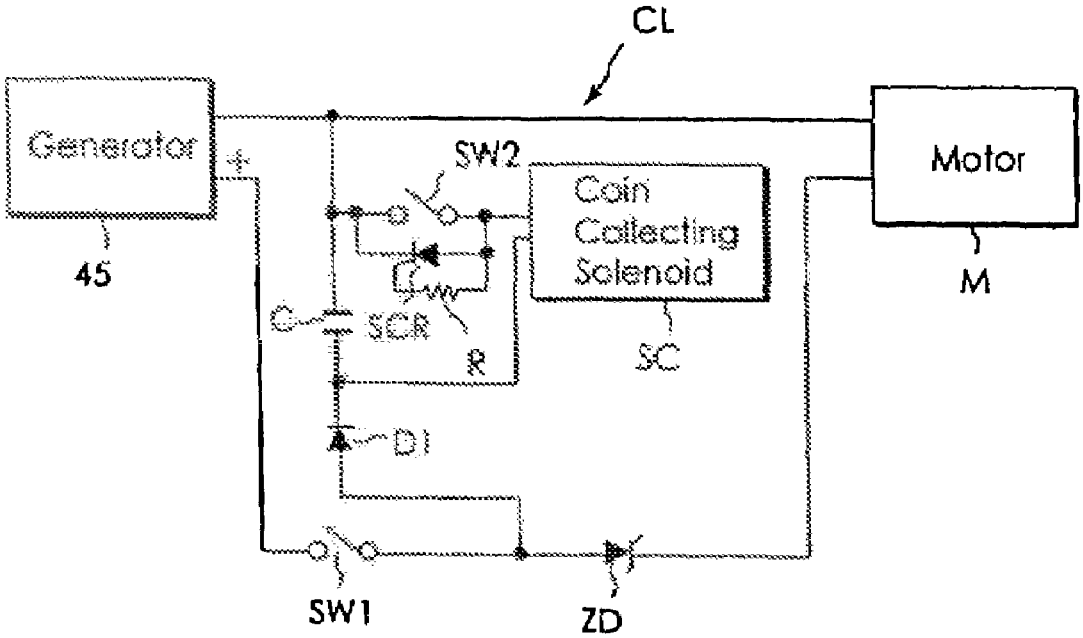
FIG. 12 is a block diagram showing an example control circuit used in the embodiment.

FIG. 11 shows how the above-mentioned arrangement of this embodiment works. FIG. 12 shows an example of a control circuit CL to drive one motor M (generally representing 49-55) by an output of the generator 45. By referring to FIG. 11, the construction and operation of the circuit of FIG. 12 will be explained. The control circuit CL shown in FIG. 12 is provided for each of four motors connected to one generator 45, and thus, in total, four control circuits CL are provided. The output of the generator 45 is supplied to the motor M through a coin insertion check switch SW1 and a Zener diode ZD. The coin insertion check switch SW1 is a normally open switch that is closed when the coin collecting device described later detects that the required number of coins are thrown in. When the generator 45 is started after the coins are thrown in, a voltage is applied to the Zener diode ZD through the switch SW1. At the same time a capacitor C is charged through a diode D. When the voltage applied to the Zener diode ZD exceeds a Zener voltage, the motor M starts. As shown in FIG. 11A, as the motor M rotates to some extent, an article falls from the upper partition wall 81 through the upper through-hole 85 onto the lower partition wall 83 (see FIG. 11A]))). As the motor M rotates further, the article 75 pushed out by the push plate 87 hits the guide wall 91 and is shoved out along the guide wall 91 until the article 75 is thrown into the guide path 71 (see FIG. 11B and FIG. 11C). When the article is pushed out, the article dispensing check switch SW2 installed in the guide path 71 turns on, discharging the electric charges from the capacitor C through a coin collecting solenoid SC and switch SW2. After the article is dispensed, the operation of the manual operation means 9 is stopped, halting the generation operation of the generator 45. At this time, the coin collecting solenoid SC remains energized by the discharging of the capacitor C. Then, the coin collecting solenoid SC causes the coin collecting device to collect the coins. While there are electric charges in the capacitor C, a self-holding circuit composed of a thyristor SCR and a resistor R is operated to have the capacitor C continue discharging. When the capacitor C is completely discharged, the coin collecting solenoid SC is de-energized, terminating the coin collecting operation. With this control circuit CL, electricity can be supplied and controlled only by the output of the generator 45 without having to use a charging means, such as battery, as a power supply for the control circuit.

Figure 13:
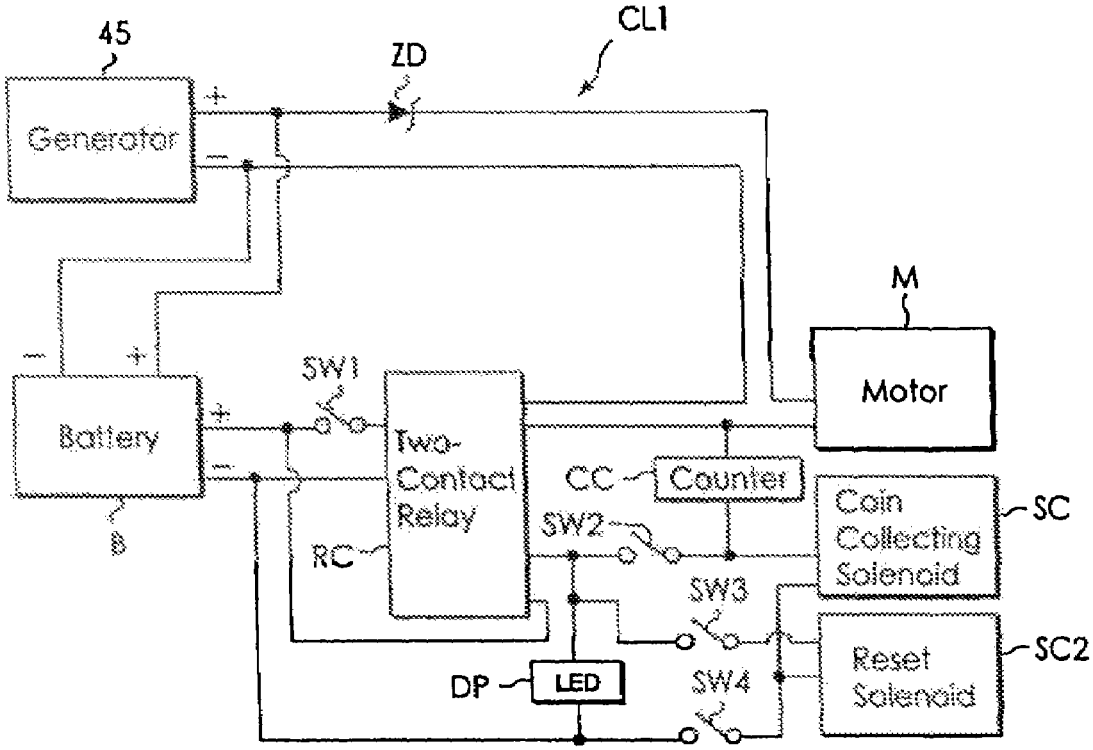
FIG. 13 is a block diagram showing another example of control circuit used in the embodiment.

FIG. 13 shows a configuration of another control circuit CL1. In this control circuit, a battery B as a secondary power supply is charged by the output of the generator 45 and this battery B is used as a control power supply for the control circuit. FIG. 13 omits a charging circuit for the battery B. In FIG. 13, members identical with those shown in FIG. 12 are given the same reference numerals. In this circuit, after the coins are thrown in and the coin insertion check switch SW1 turns on, when the generator 45 is started, the switch SW1 and one of contacts, not shown, of a two-contact relay RC turn on, electrically connecting the motor M and the generator 45 to apply the output voltage of the generator to the Zener diode ZD. When it exceeds the Zener voltage, the output of the generator 45 is supplied to the motor M which then starts rotating. A counter CC counts up each time the motor M is energized. Thus, by looking at the display of the counter CC, the number of times that the article has been dispensed can be checked. This counter CC has a reset function which permits the counter to be reset as required. When the article moving mechanism described later is driven by the rotation of the motor M to dispense an article, the article dispensing check switch SW2 installed in the guide path turns on. As the motor M rotates further and the home position detection switch SW4 turns on, detecting that the article stockers have reached the rotation start position (stocker's origin), the coin collecting solenoid SC is energized. As a result, the operation of the coin collecting solenoid SC causes the coin collecting device to collect coins. When the coin collection is performed by doing an AND operation of the switch SW2 and the switch SW4 as described above, if coins are thrown into a plurality of coin collecting devices simultaneously, only the coin collecting device associated with the article stocker, which has actually dispensed the article, performs the coin collecting operation. Therefore, when coins are thrown into a plurality of coin collecting devices, it is possible to prevent the coins thrown in from being erroneously collected. A switch SW3 is a reset switch that can be operated by a purchaser for resetting. This reset switch SW3 is ANDed with the home position detection switch SW4 to energize a reset solenoid. Thus, the resetting can only be done when the motor is not rotating. Once the motor M begins to turn, the reset operation cannot be executed until the article stocker corresponding to the motor reaches the rotation start position (until an article is dispensed). As described above, in this embodiment, since the coins are collected when the article stocker reaches the rotating start position, the resetting operation is suppressed once the corresponding motor begins rotating. When the switch SW1 is turned on after the required number of coins is thrown in, a display means DP, such as light emitting diode and voice/display means, comes on. When the switch SW1 is turned off, the display means DS goes off. This control circuit CL, as with the control circuit CL1 of FIG. 12, is provided for each article stocker.

Figure 14:
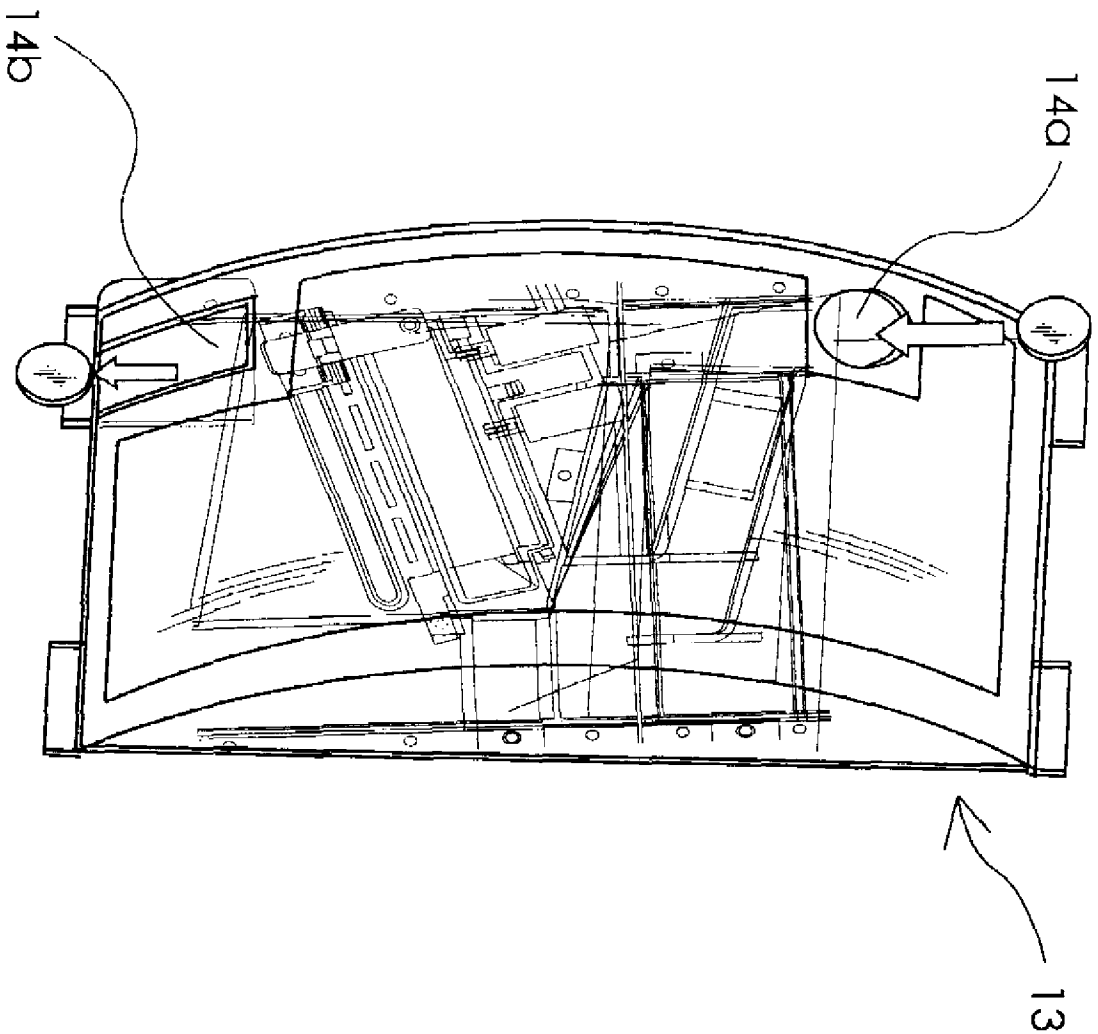
FIG. 14 is an enlarged perspective view showing a coin collecting device container.
Figure 15:
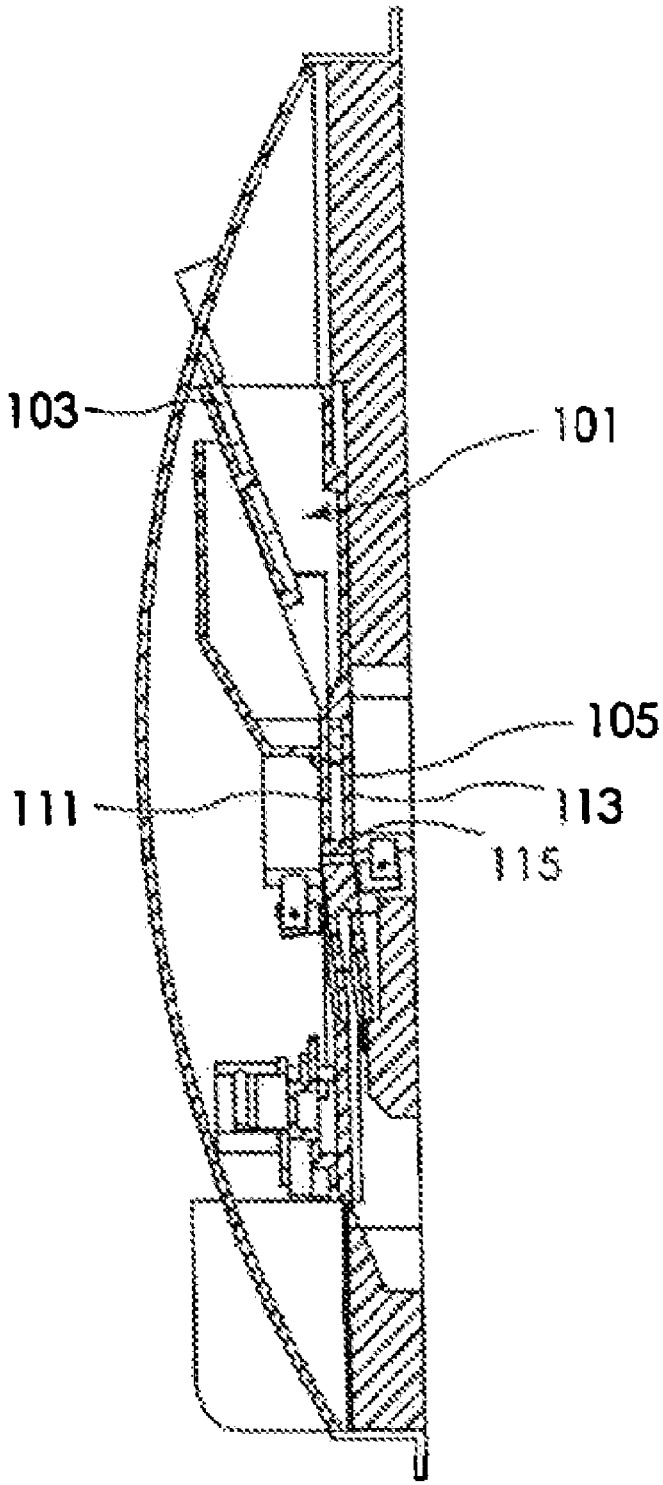
FIG. 15 is a vertical cross-sectional view showing the coin collecting device container.
Figure 16:
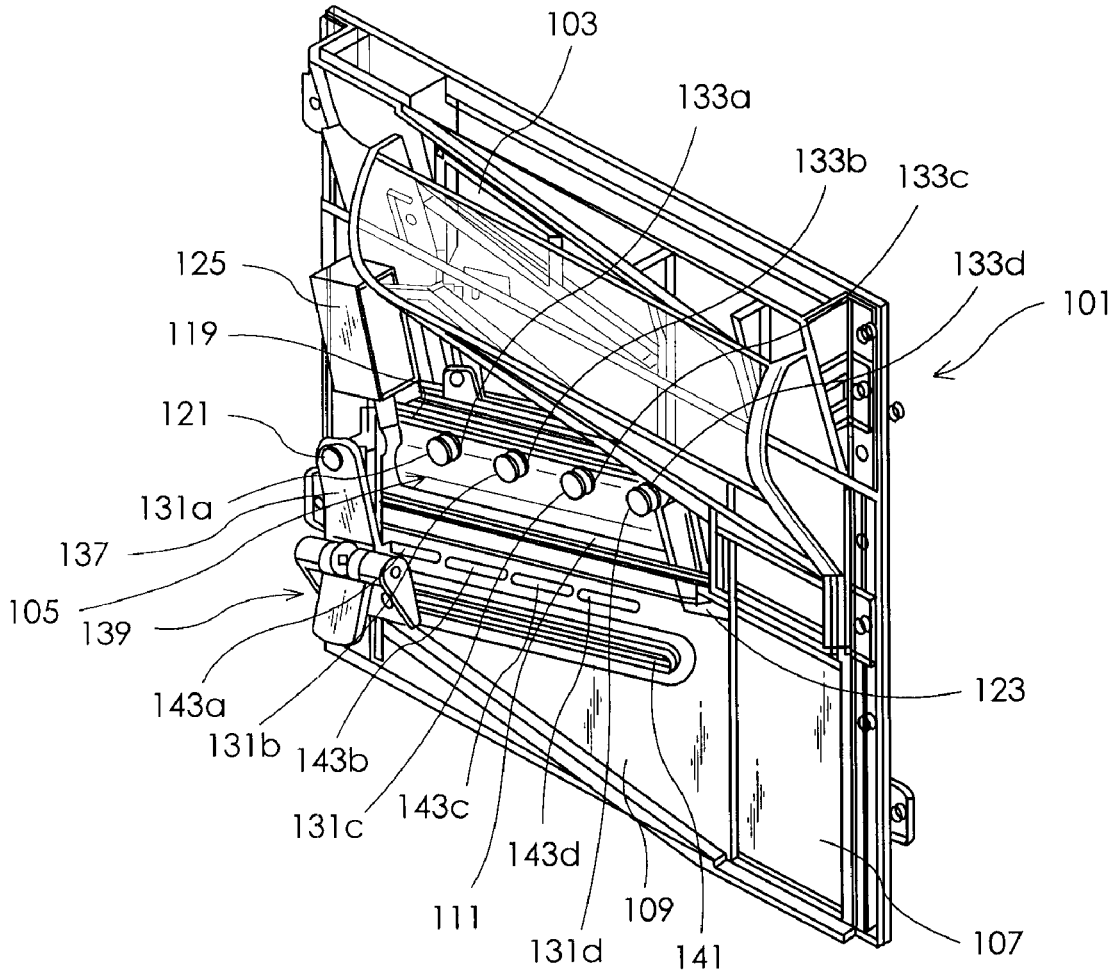
FIG. 16 is a perspective view of the coin collecting device as seen from front upper right.
Figure 17:
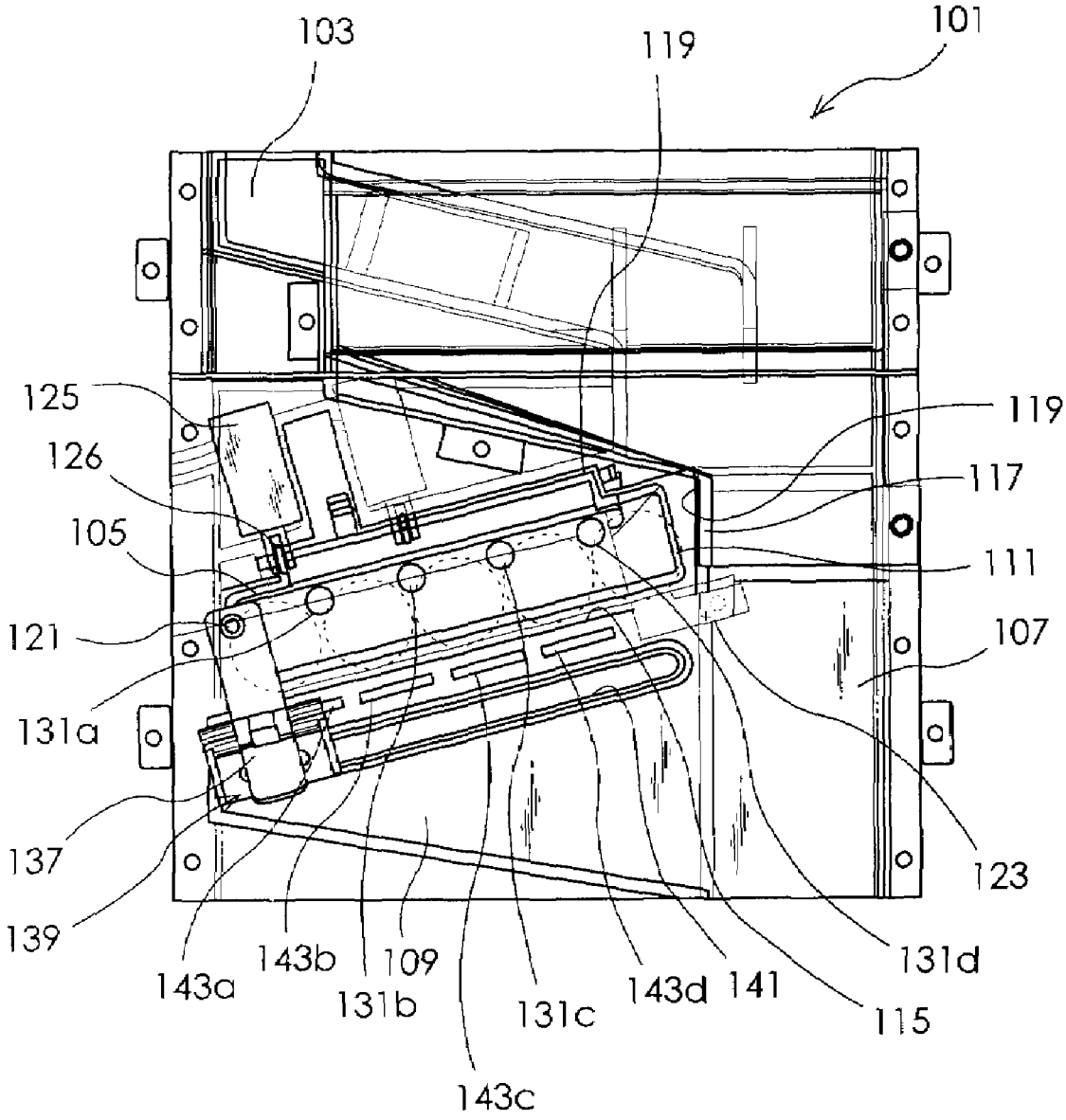
FIG. 17 is a front view of the coin collecting device.
Figure 18:
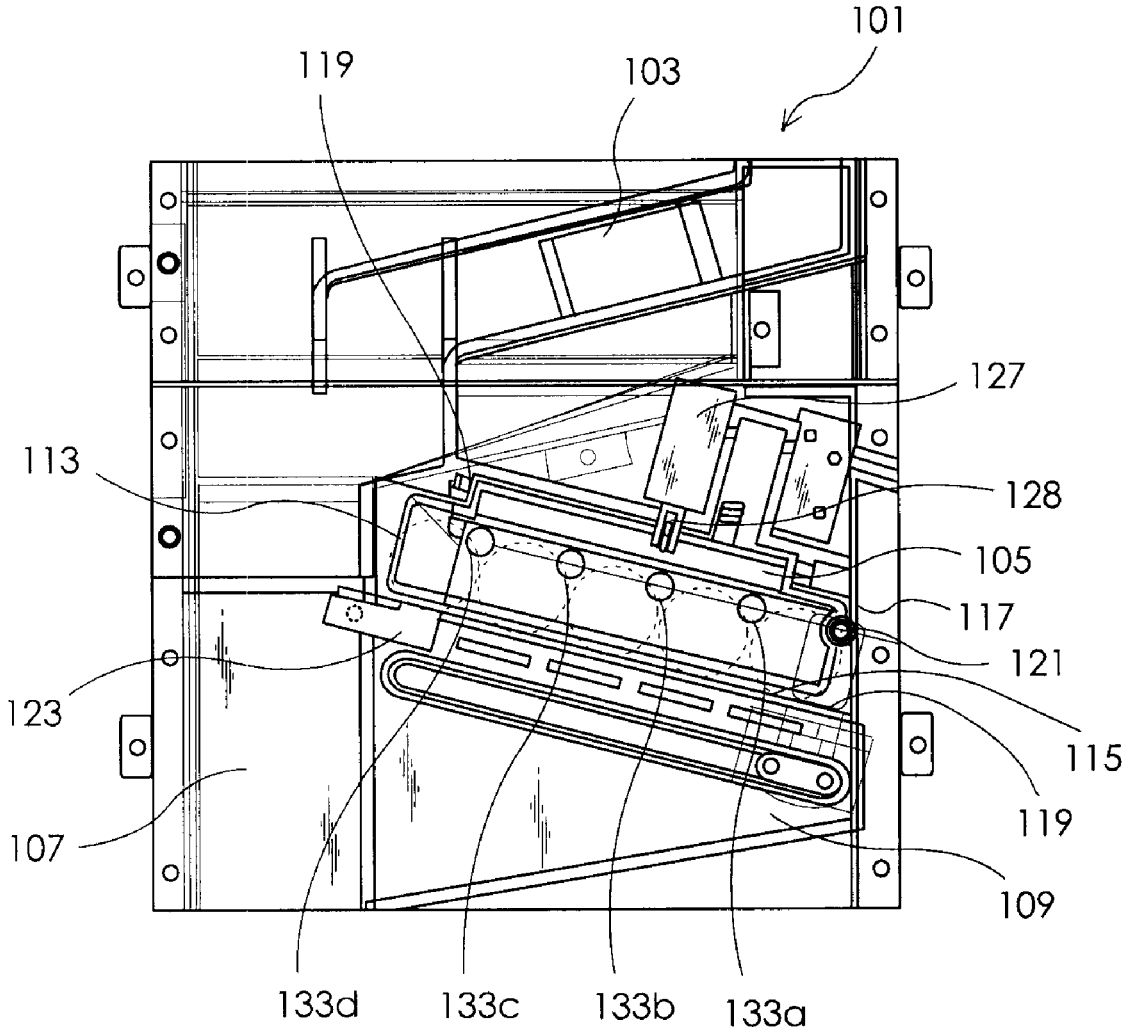
FIG. 18 is a back view of the coin collecting device.
Figure 19:
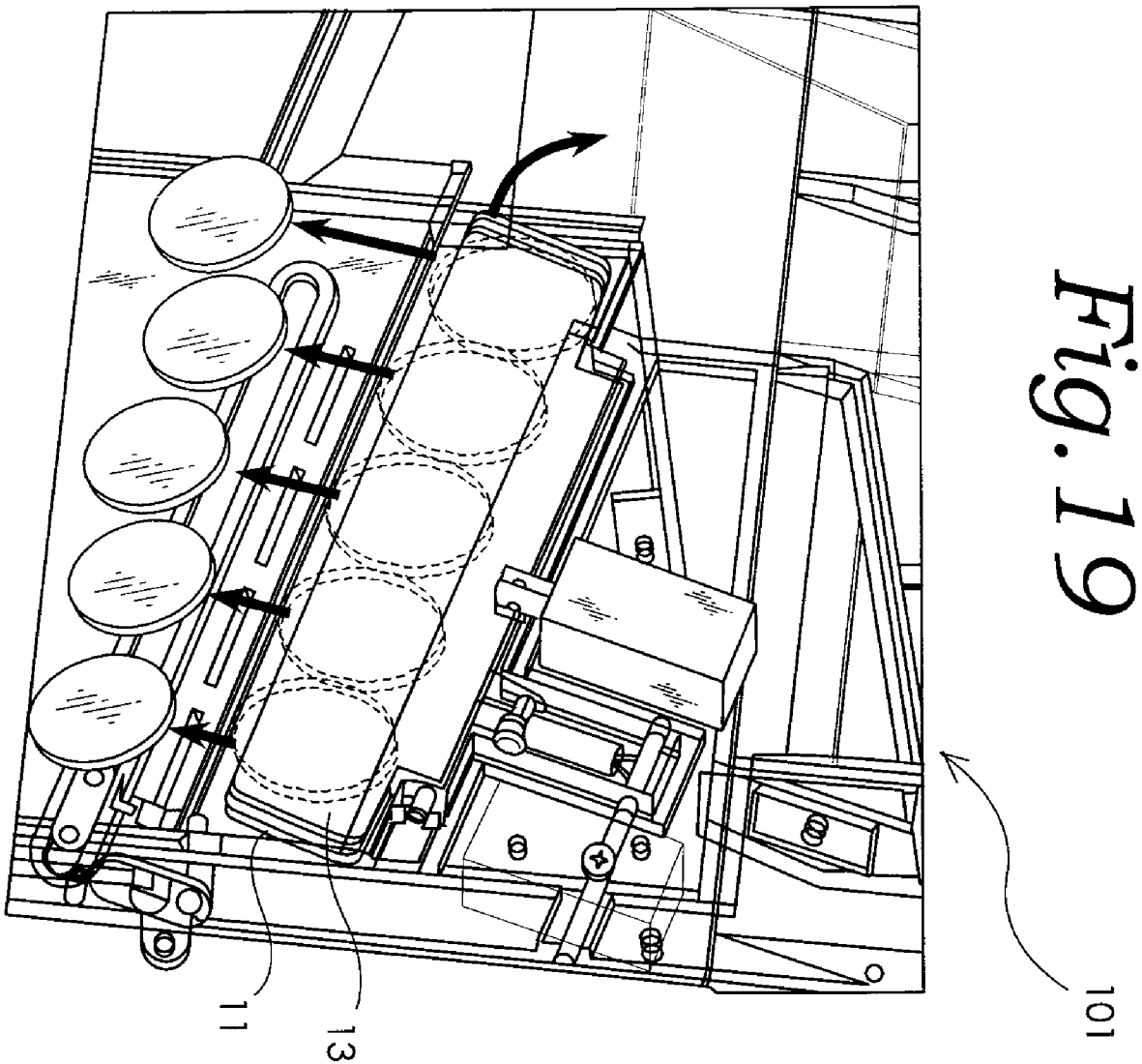
FIG. 19 is a perspective view showing coins as they are collected.

FIG. 14 is an enlarged perspective view of a coin collecting device container 13. In the coin collecting device container 13 is installed a coin collecting device 101 shown in FIG. 15 to FIG. 19. The coin collecting device 101 electrically checks if the necessary number of coins are thrown in. The coin collecting device 101 includes a coin guide 103 to guide coins thrown in from a coin slot 14*a*, a coin holding portion 105 to temporarily hold the coins that have passed the coin guide 103, a coin discharge path 107 (FIG. 16) through which coins have been thrown in more than necessary are discharged to a coin return outlet 14*b*, and a coin collecting path 109 through which to collect the required number of coins that have stayed in the coin holding portion 105. A passage from the coin slot to the coin discharge path 107 constitutes a coin path. In the coin holding portion 105 provided in the coin path, a required number of coins to purchase an article are held in a row.

The coin holding portion 105 is arranged so that one of its ends is situated lower than the other end and that the required number of coins are all held erect (namely, the diameter of the coin runs parallel to a vertical direction) and arranged side by side from one end of the coin holding portion toward the other. This arrangement produces a component of gravity acting on the coins that tends to move the coins downward. Thus, the state of contact between two adjoining coins can be kept in good condition at all times by taking most of the gravity acting on the coins. More specifically, the coin holding portion 105 includes two plate members 111, 113 spaced apart in a thickness direction and a surface 115 opposing a bottom opening of the two plate members 111, 113. The opposing surface 115 is provided by a part of an inner circumferential surface 121 of a large through-hole 119 that is formed in a base body 117 to penetrate the base body in the thickness direction of the base body. When held in the coin holding portion 105, the coins are situated between the two plate members 111, 113 with their outer circumferential portions in contact with the opposing surface 115. The two plate members 111, 113 are arranged so that they can be swung forward and backward relative to their upper edge portions through a hinge mechanism 119.

In this coin collecting device 101, the coin holding portion 105 is constructed so that coins held in line in the coin holding portion 105 are electrically connected in series. A first electrode 121 in contact with a coin situated at one end of the row of coins (at the lower end of the coin holding portion 105) is provided in the coin holding portion. A second electrode 123 in contact with a coin situated at the other end of the coin row (at the higher end of the coin holding portion 105) is also provided in the coin holding portion 105. By checking whether or not an electric current flows between the first electrode 121 and the second electrode 123, it is decided that insertion of the required number of coins is completed. In an example of this decision method, a switch may be used that turns on when electricity flows between the first electrode 121 and the second electrode 123. On the condition that this switch is on, it may be decided that the required number of coins have completely been thrown in. It is also possible to construct the switch by using the first electrode 121, the second electrode 123 and the required number of coins (namely, the required number of coins are used as a movable contact, and the first electrode 121 and the second electrode 123 as a fixed contact).

The first electrode 121 is situated to contact an upper circumferential portion of the coin located at one end (lower end) of the coin holding portion 105, and the second electrode 123 is situated to contact a lower circumferential portion of the coin located at the other end (higher end) of the coin holding portion 105. More specifically, the second electrode 123 has its electrode surface on the opposing surface 115. The first electrode 121 is constructed as a pin-shaped electrode piercing through the two plate members 111, 113. The first electrode 121 of a pin-shaped construction can be used not only as a current detection electrode but also as a stopper for coins entering into the coin holding portion 105. Thus, the first electrode 121 can be used as a means for determining the number of coins required. That is, the first electrode 121 can be changed in its mounting position, being selectively inserted into one of through-holes 131*a*-131*d* of the plate member 111 and one of through-holes 133*a*-133*d* of the plate member 113 (the latter through-holes oppose the through-holes 131*a*-131*d* in the direction of thickness of the plate members 111, 113), thereby constituting a means for determining the number of coins required. In this case, an electrode holding structure 139 having an electrode holder 137 to hold the pin-shaped first electrode 121 is constructed so that, when the two plate members 111, 113 swing toward the coin collecting side, the electrode holder 137 also swings along with the two plate members 111, 113. As described above, the pin-shaped first electrode 121 constitutes a means for determining the number of coins entering between the two plate members. With this arrangement, the first and second electrodes 121, 123 do not hinder the passage of coins entering into the coin holding portion 105. Also when the coins are discharged from the coin holding portion, these electrodes rarely become a hindrance, thus facilitating the structural design.

The coin collecting mechanism that collects coins after discharging or dispensing an article is constructed so that, when the two plate members 111, 113 are swung to one side (in this example, toward the front side), the row of coins is brought out of alignment with the opposing surface 115 to drop down from between the two plate members 111, 113 into a coin box not shown. This construction allows the coins to fall and be collected securely only by the swing operation of the two plate members.

To realize the swing operation of the two plate members 111, 113, two solenoids (electromagnetically energized operation mechanisms) 125, 127 are arranged on both sides of the two plate members 111, 113. The solenoid 125 installed on the front side (on the side of the plate member 111) is a coin collecting solenoid, and the solenoid 127 installed on the rear side (on the plate member 113 side) is a reset solenoid. When the solenoid 125 is energized to pull up a piston member 126, the two plate members 111, 113 swing toward the front side. A connecting structure between a piston member 128 of the other solenoid 127 and the plate member 113 is constructed to cause the plate member 113 to swing rearward when the piston member 128 is pulled up. However, when the plate member 113 is swung forward, the connecting structure allows its swinging operation. If the purchaser wants the inserted coins returned and the solenoid 127 is energized, the piston member 128 of the solenoid 127 is pulled up to cause the two plate members 111, 113 to swing rearward. A connecting structure between the piston member 126 of the solenoid 125 and the plate member 111 is constructed to cause the plate member 111 to swing to the front side when the piston member 126 is pulled up. But when the plate member 111 is swung rearward, the connecting structure allows its swinging operation.

In this embodiment, to use the first electrode 121 as a means for determining the required number of coins, the base body 117 provided with the opposing surface 115 is formed with a slide groove 141 disposed below, and extending parallel to, the opposing surface 115. In the slide groove 141, a part of the electrode holding structure 139 is slidably fitted. Further, between the slide groove 141 and the opposing surface 115, a plurality of positioning grooves or recesses 143*a*-143*d* are formed to extend at intervals along the slide groove 141. The electrode holding structure 139 is provided with a positioning portion (not shown) which is engaged in the positioning groove or recess 143*a*-143*d*. With this arrangement, simply sliding the electrode holding structure 139 along the slide groove 141 and fitting the positioning portion of the electrode holding structure 139 into one of the positioning grooves or recesses 143*a*-143*d* can easily position and secure the electrode.

In the coin collecting device 101, since an electric current does not flow between the first electrode 121 and the second electrode 123 through the coins unless the required number of coins exist in line in the coin holding portion 105, it is possible to easily and reliably decide when the required number of coins have been inserted. Particularly, when there is a forged coin made of other than a metal among the inserted coins, electric current does not flow. So, it is also possible to check if forged coins are thrown in. If the forged coins inserted are made of metal and a resistance of the forged coin metal differs from that of the genuine coins, a current value flowing between the first electrode and the second electrode (or an overall resistance) also differs. Therefore, measuring the current value (resistance value) can determine whether or not any forged metal coins are included in the coins thrown in.

Referring to the circuits of FIG. 12 and FIG. 13, a switch SW1 is an equivalent of the coin insertion completion detection means.

INDUSTRIAL APPLICABILITY

According to the present invention, since the motor is driven by utilizing the electric power obtained by rotating the generator using the force applied from the manual operation means. Compared to the conventional arrangement, such an advantage is obtained that the arrangement of the drive force generation/transmission mechanism is simplified. Therefore, the vending machine can be designed easily. In addition, even when the number of the article stockers is increased, the arrangement of the drive force generation/transmission mechanism is not complicated. Further, since the generator is provided, there is such an advantage that electrical and voice indication become possible without using commercial power.

The invention claimed is:

1. An vending machine, comprising:

n (n is an integer of 2 or more) article stockers that respectively store a plurality of articles;

one article guide path;

n article moving mechanisms provided respectively to the n article stockers, which move one of the plurality of articles stored in the n article stockers into the one article guide path;

one manual operation means that is manually driven; and a drive force generation/transmission mechanism that generates a drive force by utilizing a force applied from the one manual operation means and transmits a drive force selectively to the n article moving mechanisms as an operation source therefor, the drive force generation/transmission mechanism including a generator that generates an electric power by utilizing a force applied from the one manual operation means, n motors correspondingly provided for the n article stockers and selectively driven by utilizing the electric power generated by the one generator provided for the n article stockers and a motor selection/drive device that drives only one of the motors selected when operating the manual operation means, and n coin collecting devices provided correspondingly at the n article stockers to collect a required number of coins for dispensing the article, wherein the n article moving mechanisms are constructed to operate by utilizing the output of the corresponding motors as the operation source;

wherein the motor selection/drive device is constructed to select the motor corresponding to the coin collecting device to which the required number of coins have been inserted and to supply the electric power from the generator only to the selected motor; and wherein the coin collecting device is constructed to collect the inserted coins after the article has been moved into the article guide path by the operation of the article moving mechanism.

2. The vending machine according to claim 1, wherein the motor selection/drive device is constructed so that a timing of starting to drive each of the plurality of motors corresponding to the plurality of coin collecting devices is defined to be different from each other in order to prevent two or more articles from being put substantially simultaneously into the article guide path by the operation of the plurality of article moving mechanisms when the required number of coins have been inserted in the plurality of coin collecting devices.

3. The vending machine according to claim 1, further comprising a battery or rechargeable battery to be charged with the output of a battery or the generator, wherein the battery or the battery or rechargeable battery is used as a driving power source for the motor selection/drive device.

4. The vending machine according to claim 1, further comprising a capacitor to be charged with the output of the generator, which is used as a driving power source for the coin collecting device.

5. The vending machine according to claim 1, further comprising a display device that carries out electrical and/or voice indication by using the output of the generator.

6. The vending machine according to claim 1, wherein the manual operation means includes a rotary member rotating about a rotating shaft and a handle section provided at the rotary member, which is driven to rotate the rotary member, and wherein the drive force generation/transmission mechanism includes an accelerating mechanism that causes the rotating shaft of the generator to rotate at a higher speed than that of the rotary member.

7. The vending machine according to claim 1, wherein the article moving mechanism includes a rotating shaft having an axis line that coincides with a center line of the article stocker and is driven by the drive force to rotate the article stocker, a first moving mechanism that moves the article from the article stocker, which is rotated as the rotating shaft rotates, to a predetermined position, and a second moving mechanism that moves the article, which has been moved to the predetermined position as the rotating shaft rotates, into the article guide path.

8. A vending machine, comprising:

n (n is an integer of 2 or more) article stockers that respectively store a plurality of articles;

one article guide path;

n article moving mechanisms provided respectively to the n article stockers, which move one of the plurality of articles stored in the n article stockers into the one article guide path;

one manual operation means that is manually driven; and a drive force generation/transmission mechanism that generates a drive force by utilizing a force applied from the one manual operation means and transmits a drive force selectively to the n article moving mechanisms as an operation source therefor, the drive force generation/transmission mechanism including a generator that generates an electric power by utilizing a force applied from the one manual operation means, n motors correspondingly provided for the n article stockers and selectively driven by utilizing the electric power generated by the one generator provided for the n article stockers and a motor selection/drive device that drives only one of the motors selected when operating the manual operation means, and n coin collecting devices provided correspondingly at the n article stockers to collect a required number of coins for dispensing the article, wherein the n article moving mechanisms are constructed to operate by utilizing the output of the corresponding motors as the operation source;

wherein the motor selection/drive device is constructed to select the motor corresponding to the coin collecting device to which the required number of coins have been inserted and to supply the electric power from the generator only to the selected motor; and wherein the coin collecting device is constructed to permit the inserted coins to be reset only when the article moving mechanism is located at a operation start position.

9. The vending machine according to claim 8, further comprising a battery or rechargeable battery to be charged with the output of a battery or the generator, wherein the battery or the battery or rechargeable battery is used as a driving power source for the motor selection/drive device.

10. The vending machine according to claim 8, further comprising a capacitor to be charged with the output of the generator, which is used as a driving power source for the coin collecting device.

11. The vending machine according to claim 8, further comprising a display device that carries out electrical and/or voice indication by using the output of the generator.

12. The vending machine according to claim 8, wherein the manual operation means includes a rotary member rotating about a rotating shaft and a handle section provided at the rotary member, which is driven to rotate the rotary member, and wherein the drive force generation/transmission mechanism includes an accelerating mechanism that causes the rotating shaft of the generator to rotate at a higher speed than that of the rotary member.

13. The vending machine according to claim 8, wherein the article moving mechanism includes a rotating shaft having an axis line that coincides with a center line of the article stocker and is driven by the drive force to rotate the article stocker, a first moving mechanism that moves the article from the article stocker, which is rotated as the rotating shaft rotates, to a predetermined position, and a second moving mechanism that moves the article, which has been moved to the predetermined position as the rotating shaft rotates, into the article guide path.

* * * * *

UNITED STATES PATENT AND TRADEMARK OFFICE

CERTIFICATE OF CORRECTION

PATENT NO. : 7,793,769 B2
APPLICATION NO. : 10/596906
DATED : September 14, 2010
INVENTOR(S) : Kumabe et al.

It is certified that error appears in the above-identified patent and that said Letters Patent is hereby corrected as shown below:

On Title Page 2, Item (56), under "FOREIGN PATENT DOCUMENTS", in Column 1, Line 3, delete "57-9838" and insert -- 57-9898 --

In Column 13, Line 34, in Claim 3, after "wherein the battery" delete "or the battery".

In Column 14, Line 37, in Claim 9, after "wherein the battery" delete "or the battery".

Signed and Sealed this
Thirteenth Day of September, 2011

David J. Kappos

David J. Kappos
*Director of the United States Patent and Trademark Office*